US010208937B2

(12) United States Patent
Dorn et al.

(10) Patent No.: US 10,208,937 B2
(45) Date of Patent: Feb. 19, 2019

(54) LIGHT EMISSION SYSTEM

(71) Applicant: VALEO VISION, Bobigny (FR)

(72) Inventors: David Dorn, Bobigny (FR); Christophe Cherreau, Bobigny (FR); Pierre Renaud, Bobigny (FR); Silas Bakary, Bobigny (FR); Laurent Garrouste, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/717,460

(22) Filed: Sep. 27, 2017

(65) Prior Publication Data

US 2018/0087761 A1 Mar. 29, 2018

(30) Foreign Application Priority Data

Sep. 27, 2016 (FR) ..... 16 59143

(51) Int. Cl.

| | |
|---|---|
| ***F21V 23/06*** | (2006.01) |
| ***F21V 29/508*** | (2015.01) |
| ***F21V 29/70*** | (2015.01) |
| ***F21V 19/00*** | (2006.01) |
| ***F21V 23/00*** | (2015.01) |

(Continued)

(52) U.S. Cl.

CPC ..... *F21V 23/06* (2013.01); *F21S 41/141* (2018.01); *F21S 41/192* (2018.01); *F21V 19/003* (2013.01); *F21V 23/001* (2013.01); *F21V 29/508* (2015.01); *F21V 29/70* (2015.01); *H01R 12/7052* (2013.01); *H01R 12/716* (2013.01); *H01R 13/6272* (2013.01); *F21S 45/47* (2018.01); *F21Y 2115/10* (2016.08)

(58) Field of Classification Search

CPC ..... F21V 23/00; F21V 23/06; F21V 23/001; F21V 29/70; F21V 29/508

See application file for complete search history.

(56) References Cited

U.S. PATENT DOCUMENTS

| | | | | |
|---|---|---|---|---|
| 9,146,027 | B2 * | 9/2015 | Zantout | F21V 21/088 |
| 9,249,955 | B2 * | 2/2016 | Schroll | F21V 29/507 |

(Continued)

FOREIGN PATENT DOCUMENTS

| | | |
|---|---|---|
| EP | 2 175 195 A1 | 4/2010 |
| EP | 2 333 398 A2 | 6/2011 |
| EP | 2 503 652 A1 | 9/2012 |

OTHER PUBLICATIONS

French Preliminary Search Report dated Feb. 6, 2017 in French Application 16 59143 filed on Sep. 27, 2016 (with English Translation of Categories of Cited Documents).

*Primary Examiner* — Steven S Paik
*Assistant Examiner* — April Taylor
(74) *Attorney, Agent, or Firm* — Oblon, McClelland, Maier & Neustadt, L.L.P.

(57) ABSTRACT

The invention relates to a light emission system that includes a light source support having a first cooperation member, a printed circuit board fixed to the light source support and a connection system, a connection cable including a connection plug. The connection plug has a second cooperation member. The connection system, the support and the plug are arranged in such a way that when the connection system and the plug are connected to one another, the first and the second cooperation members cooperate together to form a fixed mechanical link.

14 Claims, 2 Drawing Sheets

(51) Int. Cl.

| | |
|---|---|
| ***H01R 12/70*** | (2011.01) |
| ***H01R 12/71*** | (2011.01) |
| ***H01R 13/627*** | (2006.01) |
| ***F21S 41/19*** | (2018.01) |
| ***F21S 41/141*** | (2018.01) |
| *F21Y 115/10* | (2016.01) |
| *F21S 45/47* | (2018.01) |

(56) References Cited

U.S. PATENT DOCUMENTS

| | | | | |
|---|---|---|---|---|
| 2009/0207617 | A1 | 8/2009 | Merchant et al. | |
| 2010/0085770 | A1 | 4/2010 | Matsunaga | |
| 2011/0136394 | A1 | 6/2011 | Mostoller et al. | |
| 2012/0264326 | A1 | 10/2012 | Kudo et al. | |
| 2013/0107564 | A1* | 5/2013 | Yatsuda ..... | F21S 45/48 362/543 |
| 2015/0131301 | A1 | 5/2015 | Ho | |

* cited by examiner

LIGHT EMISSION SYSTEM

BACKGROUND

The invention relates to a light emission system, in particular a light emission system of a motor vehicle light device. More particularly, the invention relates to cooperation members making it possible to ensure the link between the constituent elements of the light emission system.

Light emission systems are known bearing a light source of light-emitting diode (LED), laser, halogen or similar type. Generally, the light emission system comprises a support bearing the light source and wiring making it possible to power and drive said source.

In the case of the light emission systems bearing LEDs, a printed circuit board (PCB) is associated with the LED in order to supply it with electricity, drive it and monitor the correct operation thereof. A connecting cable is connected to the printed circuit board to convey the electrical current and allow it to perform all its functions.

Common practice is to have the connecting cable comprise a connection plug adapted to cooperate with a connection system linked electrically to the printed circuit board. Since the printed circuit board is generally fixed, by welding or by gluing, to the support, the connecting cable, once connected to the printed circuit board, is held linked to the support.

However, the link between the connecting cable and the support, among other things between the connection plug and the connection system, exhibits a risk of disconnection. In effect, the connection plug risks being detached from the connection member because of the vibrations, impacts or other factors weakening the cooperation between the plug and the connection member. The detachment of the connecting cable causes the light source to switch off which risks, in some cases, causing accidents, for example when the light emission system is installed in a motor vehicle lighting device.

BRIEF SUMMARY

One objective of the invention is to provide a light emission system that reduces the risk, to the point of even exhibiting no risk of detachment between the connection plug and the connection system over time, which makes it possible to further secure the electrical connection of the light emission system during its use.

To this end, a first subject of the invention is a light emission system comprising:

- a light source support comprising a first cooperation member,
- a printed circuit board fixed to the light source support and comprising a connection system,
- a connecting cable comprising a connection plug, this connection plug comprising a second cooperation member.

According to the invention, the connection system, the support and the plug are arranged in such a way that when the connection system and the plug are connected to one another, the first and the second cooperation members cooperate together to form a fixed mechanical link.

A fixed mechanical link should be understood to be a link that exhibits no degree of freedom, in particular a plug-in link according to the expression used in the mechanical field. Thus, by virtue of the first and second cooperation members, the connection system and the plug, once connected to one another, are kept secured over time despite the external stresses, such as vibrations, impacts or similar. There is therefore less, even no, risk of detachment of the connecting cable from the printed circuit board, which makes it possible to ensure the correct operation of the light powered and driven by said printed circuit board over a long period of use. That also means that the light emission system is more secured, which makes it possible to avoid untimely light outages, which can cause accidents when said system is incorporated in a motor vehicle lighting device.

In the present document, the light source is for example an electroluminescent light source. Such a light source uses electroluminescence. Electroluminescence is an optical and electrical phenomenon during which a material emits light in response to an electrical current passing through it, or to a strong electrical field.

The light emission system according to the invention can optionally comprise one or more of the following features:

- the first and the second cooperation members are arranged in such a way as to engage with and immobilize one another by clipping; thus, it is easy to produce structurally simple and inexpensive mechanical parts which ensure cooperation by clipping one into the other;
- the first cooperation member comprises a hole and the second cooperation member comprises a snug, the snug and the hole being arranged in such a way that when the connection system and the plug are connected to one another, the snug is in abutment against an edge of the hole; thus, the hole, being formed in the support, is simple to produce. Furthermore, this solution is economically advantageous in as much as there is no need for an additional piece to cooperate with the snug borne by the connection plug. The light source support is used shrewdly to provide a cooperation member compatible with the snug. Moreover, during the assembly of the light source support, it is sufficient to place the snug against an edge of the hole to hold the connection system and the connection plug together, which makes it possible to increase the assembly rate, therefore the productivity of the light emission system production line. Conversely, to dismantle the light emission system, it is sufficient to release the snug from the hole by a simple and practical gesture after which the light source support is detached from the connecting cable and can be handled easily, for example during an operation to change an old support for a new one;
- the snug extends in a first direction and it has a triangular section in the first direction; such a form is easier to produce, particularly by moulding;
- the first and second cooperation members have mutually complementary forms; thus, there is a better hold between the cooperation members, which further strengthens the fixed mechanical link between them;
- a light source fixed directly or indirectly to the light source support and connected to the printed circuit board;
- the light source support is a heat sink; as an example, the heat sink is installed in a motor vehicle lighting device;
- according to the preceding paragraph, the heat sink comprises a plate made of conductive material to which the printed circuit board is fixed, the first cooperation member being formed by a through-hole in said plate; as an example, the through-hole can be produced by laser cutting or by stamping which are operations that are simple and rapid;
- the connection system comprises a body adapted to be connected to the printed circuit board, and a connection member adapted to cooperate with the connection plug in a first direction. The body of the connection system is disposed at a distance from an edge of the hole so that the space between the body and the edge in the first direction forms a recess in which the second cooperation member is placed; thus, when the connection and the connection plug are plugged into one another, the second cooperation member is in abutment against the edge of the hole;

according to the preceding paragraph, the distance between the body and the edge of the hole in the first direction can be substantially identical to the dimension of the second cooperation member in this same direction; the connection is thus tight and the risks of disconnection linked to the vibrations are reduced;

the printed circuit board is fixed onto a first face of the plate, the connection system being connected to the printed circuit board in such a way that a body of the connection system passes through the hole and protrudes from a second face of the plate, opposite the first face and that a connection member of the connection system is situated on the side of the second face and adapted to cooperate with the connection plug; in other words, the printed circuit board is located on one side of the support and the connection cable is located on the other; thus, the connection of the connecting cable to the connection system or the separation of these two elements is performed away from the printed circuit board, which makes it possible to avoid the contact with the latter and therefore have lesser risks of damaging it;

the connection member and the connection plug are of male/female type.

The invention relates also to a vehicle light device comprising at least one light emission system according to the invention.

This vehicle light device can be:

a road lighting device, in particular a headlight or a fog light;

a signaling light, in particular: a stop light, a day time running light (DRL), a night position indicator, a direction indicator;

an interior lighting device, namely for the interior of a motor vehicle, notably: a firm light or a wall-mounted luminaire.

The invention relates also to a vehicle comprising at least one light device according to the invention.

BRIEF DESCRIPTION OF THE DRAWINGS

Other innovative features and advantages will emerge from the following description, provided in an indicative and nonlimiting manner, with reference to the attached drawings, in which.

DETAILED DESCRIPTION

Figure 1:
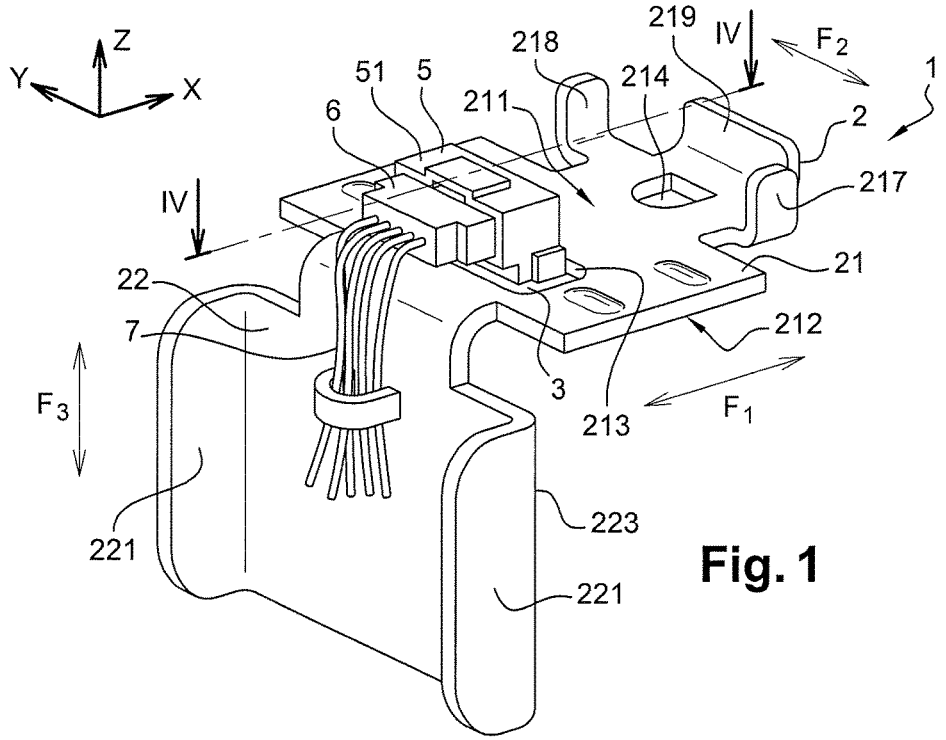
FIG. 1 represents a perspective schematic view of a light emission system according to an embodiment of the invention.

Referring to FIG. 1, a light emission system according to the invention, reference 1, comprises a light source support 2 bearing a light source (not represented in FIG. 1);

a printed circuit board 3, partially visible in this figure;

a connection system 5 being electrically connected to the printed circuit board;

several connecting cables 7 connected to the connection system 5 via a connection plug 6.

In the example illustrated, the light emission system 1 is adapted to be installed in a motor vehicle light device. In this example, the light device is a headlight.

The light source support 2 is configured here to both support the light source and to dissipate the heat emitted by said source. Here, the support 2 is therefore a heat sink.

The light source support 2 comprises a first plate 21 extending in a horizontal plane defined by two orthogonal vectors X and Y, with X extending in a longitudinal direction F1 of the emission system 1 and Y extending in a transverse direction F2 of said system 1. The light source support 2 further comprises a second plate 22 lying in a vertical plane defined by two orthogonal vectors Z and Y with the vector Z extending in an upward-pointing vertical direction F3 in FIG. 1.

Unless indicated otherwise, the terms "up" and "down" or "top" and "bottom", as well as "front", "rear", and "transverse" refer to the orientation in which the light emission system is intended to be arranged when the light device that includes it is mounted in a vehicle. In particular, the terms "front" and "rear" are defined in relation to the direction of light emission in the sense of light emission from the light device. This orientation is illustrated in FIG. 1.

Figure 2:
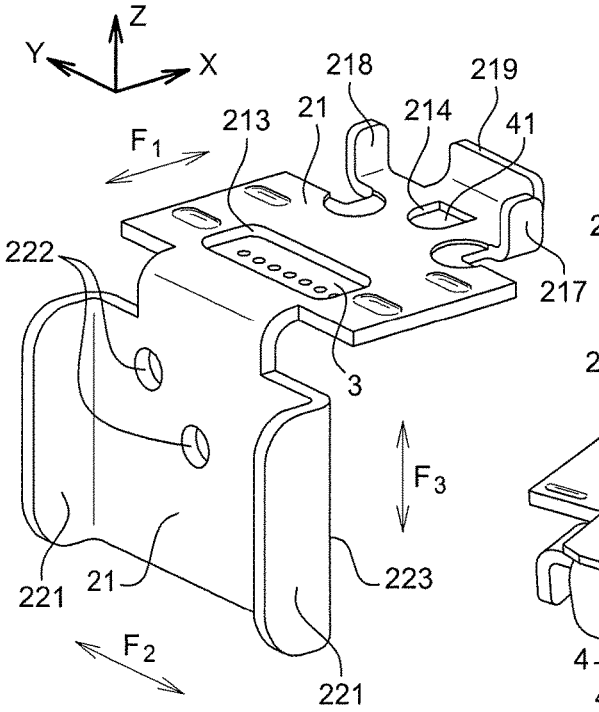
FIG. 2 and FIG. 3 represent a perspective schematic view, respectively from above and from below, of a light source support to which a printed circuit board is fixed, said light source support and said printed circuit board forming part of the light emission system according to FIG. 1.

The first plate 21 of the support 2 comprises a first face 211 oriented upward and a second face 212 oriented downward. The first plate 21 also comprises a hole 213 passing through the first face 211 to the second face 212. As illustrated in FIG. 2, the hole 213 can have a rounded rectangular form, elongate in the transverse direction F2. Hereinbelow, this hole is called "oblong hole". Moreover, the first plate 21 comprises a raised base 41 protruding from the second face 212. A light source 4, fixed onto the raised base 41, is located at the same height as the printed circuit board 3, which simplifies the establishing of the electrical connection between these two elements. Furthermore, the light source 4 is in direct contact with the plate 21, which makes it possible to better dissipate the heat emitted by said source.

In the example illustrated, cooling fins are positioned at the front of the first plate 21. They consist of two lateral fins 217, 218 and a frontal fin 219. These cooling fins extend vertically from the first face 211.

The printed circuit board 3, the function of which is to drive and power the light source 4, is fixed to the second face 212 of the first plate 21. The printed circuit board 3 is disposed in such a way as to completely block the bottom opening 215 of the hole 213 on the side of the second face 212 as represented in FIG. 3.

In the same figure, the printed circuit board 3 is fixed to the first plate 21 by screwing. As a variant, the printed circuit board 3 can be fixed by gluing or by welding, the methods known to a person skilled in the art.

As for the second plate 22 of the support 2, it comprises two lateral fins 221, opposite one another and extending backward in the longitudinal direction F1.

Figure 3:
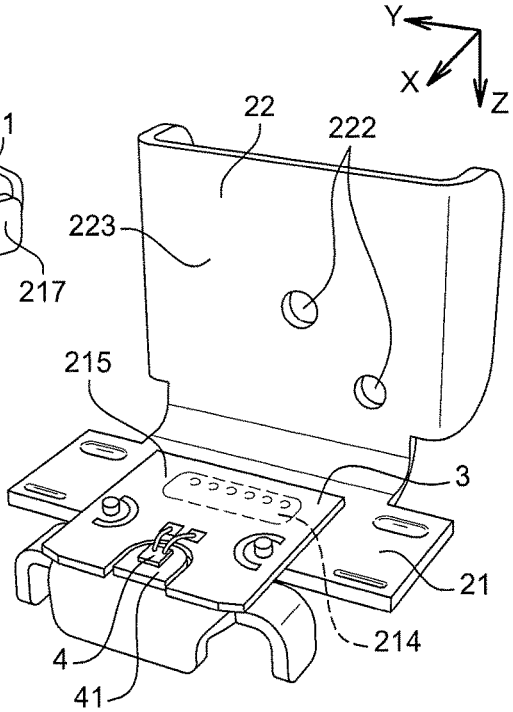

Referring to FIGS. 2 and 3, the second plate 22 also comprises through openings 222 capable of receiving fixing members of the light reflector in order to block the vertical and/or transverse translational movement of the light emission system 1. When the light source support 2 is installed on the reflector, a front face 223 of the second plate 22 is facing a rear wall of the reflector.

The light source support 2 comprising the first horizontal plate 21 and the second vertical plate 22 is obtained by a succession of steps comprising, for example:

a cutting step, a drilling step to form the oblong hole 213, the through-orifices 222, a stamping step to form the raised base 41, a first folding step to form fins of each of the plates, and a second folding step to form the first and second plates.

It should be noted that the first and second folding steps will be able to be reversed.

As an example, the light source support 2 is produced from a metal plate, this material giving it a high rigidity and a good thermal conductivity.

As can be seen in FIG. 1, the connection system 5 is linked electrically to the printed circuit board 3 by appropriate members which will be detailed later in the description.

Figure 4:
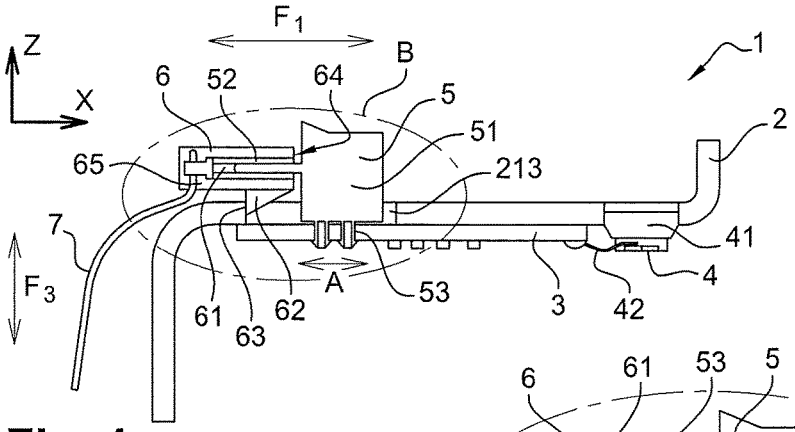
FIG. 4 represents a cross-sectional view according to IV-IV of the light emission system of FIG. 1.
Figure 5:
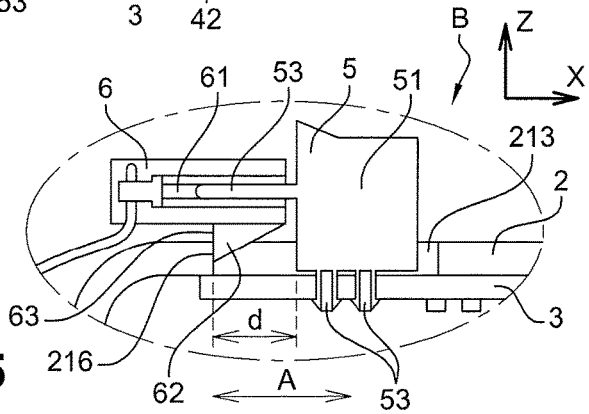
FIG. 5 represents a view of detail A of FIG. 4.

The connection system 5 comprises a body 51 bearing connection members 52, illustrated in FIGS. 4 and 5 (but not represented in FIG. 1). The connection members 52 are configured to cooperate with the connection plug 6 so as to establish an electrical connection between the plug 6 and the connection system 5. The body 51 of the connection system 5, being connected to the printed circuit board 3, passes through the hole 213 and protrudes vertically from the first face 211. The connection members 52 are placed on the side of the first face 211 while the printed circuit board 3 is situated on the side of the second face 212.

Several connecting cables 7 are connected electrically to the connection system 5 via the connection plug 6. The connecting cables 7 are linked to a central driving unit (not represented) which supplies electricity and which analyses data to monitor the correct operation and control the correct lighting of the light source. The cables 7 are thus adapted to ensure the electrical power supply and the circulation of information between the printed circuit board and the central driving unit.

Referring to FIG. 4 and to FIG. 5, the connection plug 6 and the connection system 5 are connected to one another. The light source 4, borne by the accommodating base 41, is situated at the front of the light emission system 1. In the example illustrated, the light source 4 is electrically linked to the printed circuit board 3 by soldered wires 42. Obviously, there are other means known to those skilled in the art for establishing an electrical connection between the light source 4 and the printed circuit board 3.

The body 51 of the connection system 5 is connected to the printed circuit board 3 by means of two metal pins 53 welded to the latter. As described previously, the body 51 bears connection members situated on the side opposite that of the printed circuit board 3. Here, the connection members are connection pins 52 extending backward in the longitudinal direction F1. The connection pin 52, visible in FIGS. 4 and 5, is engaged in a corresponding recess 61 of the connection plug 6. The connection system 5 and the plug 6 as described are of male/female type. As variants, the connection system 5 comprises recesses whereas the connection plug 6 comprises connection pins.

In the example illustrated, the connection plug 6 further comprises a snug 62 fixed to the bottom wall 65 of the connection plug 6. The snug 62 extends from a front face 64 of the connection plug 6 backward, in a first direction A which is, here, parallel to the longitudinal direction F1. The section of the snug in the first direction A is substantially triangular with a large base 63 situated at the rear.

Referring to FIG. 5, the body 51 of the connection system, fixed to the printed circuit board, is situated at a distance from a rear edge 216 of the hole 213 so as to leave a sufficient space to entirely house the snug 62 between the rear edge 216 and the body 51, and so that the large base 63 of the snug is in abutment against the rear edge 216 of the hole 213.

In this example, the distance d in the first direction A between the body 51 and the rear edge 216 corresponds to the dimension of the snug 62 defined in the same direction.

When the plug 6 is connected to the connection system 5, the snug 62 and the hole 213 cooperate with one another to form a fixed link exhibiting no degree of freedom of movement. Consequently, this link prevents backward slip of the connection plug 6 and therefore the detachment of the latter from the connection system when the light emission system 1 is subjected to vibrations.

Figure 6:
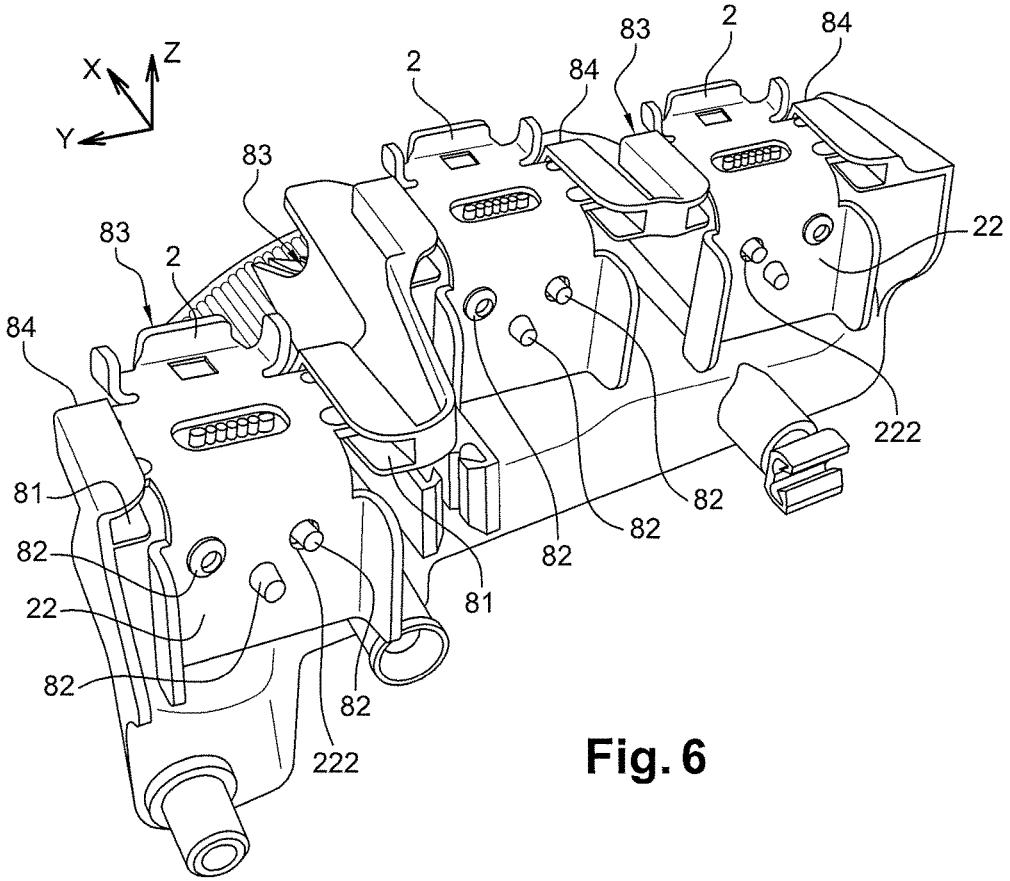
FIG. 6 represents a lighting device comprising several light emission systems such as that illustrated in FIG. 1.

In the example illustrated in FIG. 6, and in a nonlimiting manner, the light device comprises three reflectors 83, on each of which are respectively arranged a light source support 2 of the light emission system 1 according to the invention (the connection system and the connecting cables are not represented for reasons of clarity). In FIG. 6, only the position of the reflectors is identified by means of the reference 83, the reflecting surfaces of the reflectors not being visible.

The arrangement of each light emission system 1 on the corresponding light reflector 83 is produced in such a way that the light emitted is directed to the front of the vehicle by creating or by participating in the generation of a light beam, in particular a light beam observing the standards imposed in the motor vehicle domain.

For each light source support 2, the corresponding reflector 83 is arranged so as to allow an engagement of the first plate 21 in two horizontal grooves 81 disposed on either side of the first plate 21 until the latter is stopped by a front abutment 84 of the reflector 83. At the end of engagement, the second plate 22 is bearing against a rear wall of the reflector 83 and fixing and/or positioning members 82 are engaged in the openings 222 of the second plate 22 in order to prevent the vertical and transverse displacement of the support 2.

In order to strengthen the fixing of the support 2 on the reflector 83, the fixing and/or positioning members 82 comprise a screw so as to screw the second plate 22 to the rear wall of the reflector. Once the light source support 2 is installed, the light source is facing a reflecting surface of the corresponding reflector 83 making it possible to direct the light emitted forward and create a light beam or a part of a light beam with a given photometry. For example, a first assembly formed by a first light source support 2 and the associated reflector 83 allows the generation of a high beam, a second assembly formed by a second light source support 2 and the associated reflector 83 allows the generation of a part of a low beam, in particular its bottom part, a third assembly formed by a third light source support 2 and the associated reflector 83 allows the generation of another part of the low beam, in particular its oblique part.

The invention claimed is:

1. A light emission system comprising:

a light source support comprising a first cooperation member, a printed circuit board fixed to the light source support and comprising a connection system, a connection cable comprising a connection plug, the connection plug comprising a second cooperation member, wherein the connection system, the support and the plug are arranged in such a way that when the connection system and the plug are connected to one another, the first and the second cooperation members cooperate together to form a fixed mechanical link, wherein the light source support is a heat sink that comprises a plate made of conductive material to which the printed circuit board is fixed, the first cooperation member being formed by a through hole in said plate, and wherein the connection system comprises a body adapted to be connected to the printed circuit board, and a connection member adapted to cooperate with the connection plug in a first direction, and the body of the connection system is disposed at a distance from an edge of the hole in such a way that a space between the body and the edge in the first direction forms a recess in which the second cooperation member is placed.

2. The light emission system according to claim 1, wherein the first and the second cooperation members are arranged so as to engage and immobilize one another by clipping.

3. The light emission system according to claim 2, wherein the second cooperation member comprises a snug, the snug and the hole being arranged in such a way that, when the connection system and the plug are connected to one another, the snug is in abutment against the edge of the hole.

4. The light emission system according to claim 2, wherein the first and second cooperation members have mutually complementary forms.

5. The light emission system according to claim 2, wherein the light emission system comprises a light source fixed directly or indirectly to the light source support and connected to the printed circuit board.

6. A vehicle light device comprising at least one light emission system according to claim 2.

7. The light emission system according to claim 1, wherein the second cooperation member comprises a snug, the snug and the hole being arranged in such a way that, when the connection system and the plug are connected to one another, the snug is in abutment against the edge of the hole.

8. The light emission system according to claim 7, wherein the snug extends in the first direction and the snug has a triangular section in the first direction.

9. The light emission system according to claim 7, wherein the light emission system comprises a light source fixed directly or indirectly to the light source support and connected to the printed circuit board.

10. The light emission system according to claim 1, wherein the first and second cooperation members have mutually complementary forms.

11. The light emission system according to claim 1, wherein the light emission system comprises a light source fixed directly or indirectly to the light source support and connected to the printed circuit board.

12. The light emission system according to Claim 1, wherein the printed circuit board is fixed to a second face of the plate, the connection system is connected to the printed circuit board in such a way that the body of the connection system passes through the hole and protrudes from a first face of the plate, opposite the second face, and a connection member of the connection system is situated on a side of the first face and adapted to cooperate with the connection plug.

13. The light emission system according to claim 12, wherein the connection member and the connection plug are of male/female type.

14. A vehicle light device comprising at least one light emission system according to claim 1.

* * * * *